US006739345B2

(12) United States Patent
Stanley, III

(10) Patent No.: US 6,739,345 B2
(45) Date of Patent: May 25, 2004

(54) MAKE UP APPLICATION KIT

(76) Inventor: Virgil E. Stanley, III, 5860 N. Michigan Rd., Indianapolis, IN (US) 46228

( * ) Notice: Subject to any disclaimer, the term of this patent is extended or adjusted under 35 U.S.C. 154(b) by 0 days.

(21) Appl. No.: 10/047,869

(22) Filed: Jan. 15, 2002

(65) Prior Publication Data

US 2003/0131868 A1 Jul. 17, 2003

(51) Int. Cl.[7] ..... A45D 33/00

(52) U.S. Cl. ..... 132/200; 132/294; 132/314; 206/581; 206/232; 434/100; 434/103

(58) Field of Search ..... 132/200, 294, 132/293, 297, 298, 313, 314, 317; 206/581, 1.8, 1.9, 575, 308.1, 232; 434/100, 103

(56) References Cited

U.S. PATENT DOCUMENTS

| | | | | | |
|---|---|---|---|---|---|
| 1,205,779 | A | * | 11/1916 | Peck | 281/31 |
| 1,523,691 | A | * | 1/1925 | Kendall | 132/293 |
| 2,115,930 | A | * | 5/1938 | Lynn | 132/294 |
| 3,815,265 | A | * | 6/1974 | DePauw | 434/103 |
| 4,747,782 | A | * | 5/1988 | Campbell, Jr. | 434/377 |
| 4,884,680 | A | * | 12/1989 | Israel et al. | 206/44.11 |
| 5,012,927 | A | * | 5/1991 | Borst | 206/470 |
| 5,441,412 | A | * | 8/1995 | Hayles | 434/100 |
| 5,520,203 | A | * | 5/1996 | Segerstrom | 132/297 |
| 5,590,785 | A | | 1/1997 | Seitzinger | |
| 5,690,130 | A | * | 11/1997 | Gundermann et al. | 132/319 |
| 5,908,208 | A | * | 6/1999 | Lapsker | 283/56 |
| 5,913,686 | A | * | 6/1999 | Van Winkle | 434/267 |
| 5,971,351 | A | * | 10/1999 | Swaab | 249/117 |
| 6,022,219 | A | * | 2/2000 | Cohen | 434/84 |
| 6,035,857 | A | * | 3/2000 | Hartelius et al. | 132/73 |
| 6,053,322 | A | * | 4/2000 | Kim et al. | 206/575 |
| 6,119,704 | A | * | 9/2000 | Bouchat et al. | 132/320 |
| 6,122,900 | A | * | 9/2000 | Mossbeck et al. | 206/570 |
| 6,189,698 | B1 | * | 2/2001 | Asser | 206/581 |
| 6,293,284 | B1 | * | 9/2001 | Rigg | 132/200 |
| 6,338,349 | B1 | * | 1/2002 | Robinson et al. | 132/200 |
| 2002/0082745 | A1 | * | 6/2002 | Wilmott et al. | 700/233 |
| 2003/0019501 | A1 | * | 1/2003 | Hirota et al. | 132/73 |

* cited by examiner

*Primary Examiner*—Eduardo C. Robert
*Assistant Examiner*—David C Comstock
(74) *Attorney, Agent, or Firm*—Coats & Bennett, P.L.L.C.

(57) ABSTRACT

A make up kit comprises a base material in which colorants may be mixed to achieve desired hues that may then be applied to a person. The kit may further comprise a mixing dish in which the make up may be mixed and an instructional aide that instructs users on how to mix the make up paints and apply the paints.

24 Claims, 3 Drawing Sheets

MAKE UP APPLICATION KIT

BACKGROUND OF THE INVENTION

1. Field of the Invention

The present invention relates to a kit that allows individuals to mix make up on an as needed basis.

2. Description of the Related Art

Numerous occasions give rise to a desire to apply paint to one's face. Typical examples include sporting events where individuals may paint themselves in their team's colors, fairs where balloons and smiley faces are painted on children, and Halloween where the make up is used to create ghouls and goblins for trick or treating. Other situations may also arise.

Several products exist which allow users to apply such make up. One of the most common is grease paint. Another common type is a cream type make up. Glitter and sparkles are popular presently. However, these sorts of make up are typically sold in large tubes of a single color. To achieve a two toned face, such as may commonly be seen at a basketball game, two such tubes must be purchased. The amount of paint required to paint a face, or even a full upper body is usually substantially less than a full tube. This leaves a large amount of unused paint. For individuals that regularly paint themselves, this may not be a problem. But for the occasional face painter, this results in waste.

Still another problem presently exists in the field of face painting; namely, many designs may be difficult to create for a layperson. For example, a good clown face is surprisingly hard to achieve. Lay face painters may need additional instruction on how to maximize their face painting efforts and achieve good looking make up jobs.

SUMMARY OF THE INVENTION

The present invention addresses many of the concerns present in the prior art by providing a kit that comprises a base material to which may be added colorants. In this manner, small amounts of colored make up may be created for use without having to purchase large tubes of paint and wasting much of it. The kit may further comprise an instructional pamphlet or compact disc that comprises instructions on ratios of colorant to base material and assists a user in creating aesthetically pleasing make up jobs.

DETAILED DESCRIPTION OF THE INVENTION

Figure 1:
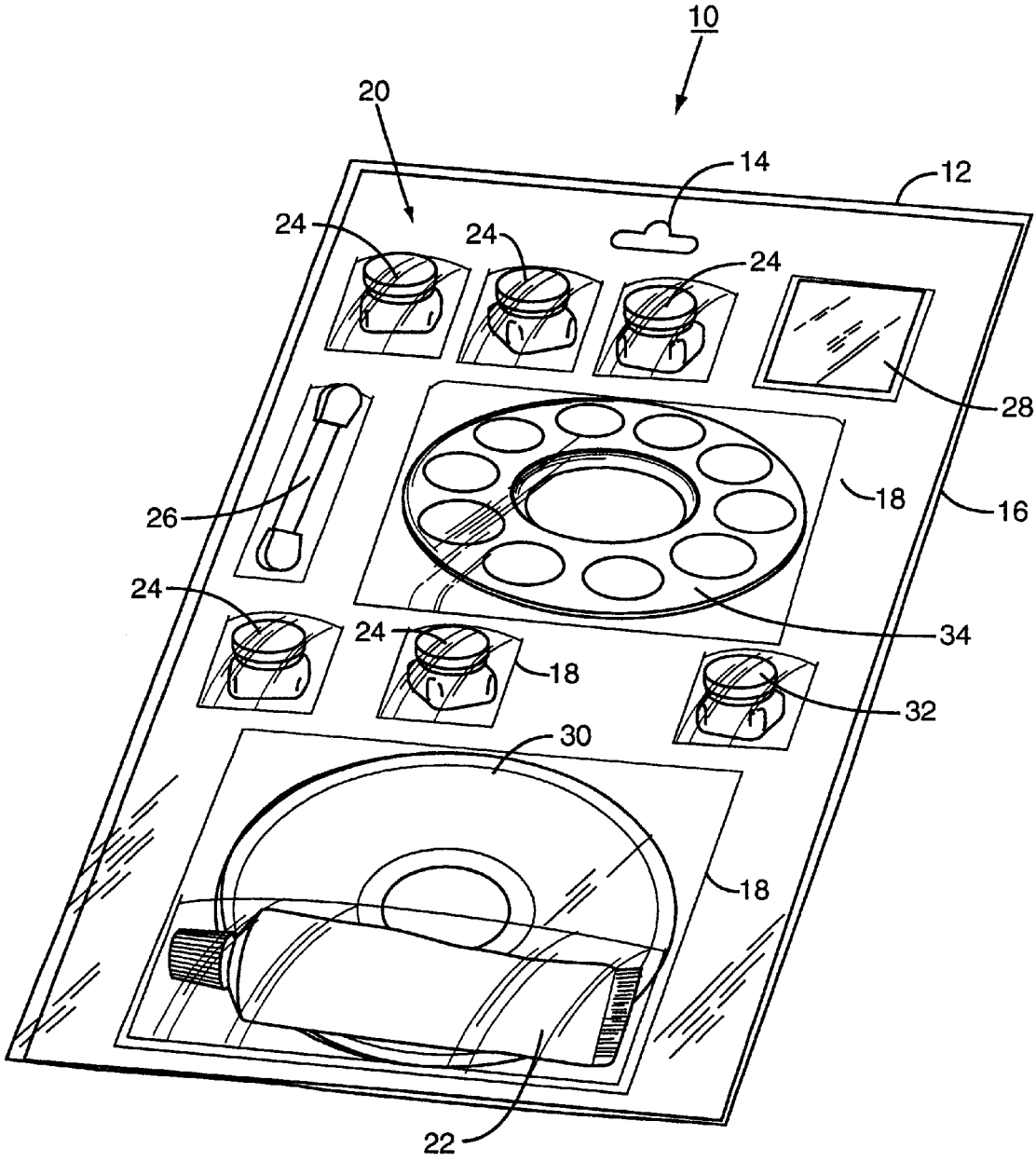
FIG. 1 illustrates a perspective view of a make up kit according to one embodiment of the present invention.

The present invention comprises a make up kit, illustrated generally at 10 in FIG. 1. The make up kit 10 is well adapted for retail sale, and may comprise a header card or other package 12 with aperture 14 designed to hang from a conventional retail stock hook. Transparent blister cover 16 may cover header card 12 and comprise pockets 18 sized and shaped so as to accommodate make up materials 20 therewithin and hold make up materials 20 against header card 12 as is well understood. Other types of securing means may also be used such as stretchable or elastic bands that hold make up materials 20 against header card 12. Tape or other adhesives such as rubber cement may be used as needed or desired.

Header card 12 may comprise printed indicia thereon (not shown explicitly for clarity) that may comprise a trademark or logo, instructions, colorful graphics or the like.

Make up materials 20 may comprise a base material 22, colorants 24, an applicator 26, a mirror 28, and the like. While nice accessories, applicator 26 and mirror 28 are optional. Further, it should be appreciated that the make up kit of the present invention contain a paint brush, sponge or other type of applicators. Also present, perhaps sandwiched between blister cover 16 and header card 12 is an instructional guide 30 and mixing dish 34. Instructional guide 30 may be a compact disc (shown) or a printed pamphlet.

As would be expected, base material 22 and colorants 24 may be positioned within containers. These containers may be squeeze tubes, paint pots, or the like as needed or desired. Additionally, an empty container 32 may be provided in which to mix base material 22 and a desired colorant 24. The base material 22 may comprise a conventional cream, grease or powder of a beige or off-white tone. Also contemplated are tablets or powders that may be mixed with water to form the base. Colorants 24 may comprise color concentrates. These concentrates may be in drop form, paste form, gel form, powder form, liquid form or the like. When mixed with base material 22 in empty container 32 or a mixing dish 34, a make up paint is formed which may be applied to an individual. In an exemplary embodiment, colorants for blue, red, yellow, black, white, brown, purple, and the like may be included. In addition, glitter and sparkles may be included.

Applicator 26 may comprise a brush, a sponge, or other type of tool appropriate for mixing and/or applying compositions.

Instructional guide 30, as previously indicated may be a compact disc, a pamphlet or the like. Instructional guide 30 comprises detailed step by step instructions on mixing the base material 22 with colorants 24 to achieve desired hues as well as instructions and examples of make up schemes that may be copied to achieve desired appearances. For example, one set of instructions within instructional guide 30 may comprise instructions on how to create a desirable green hue and instructions on how to create a FRANKENSTEIN-like monster. Other creatures, clown faces, and the like are also contemplated. In the event that instructional guide 30 is a compact disc, it may be loaded onto a computer or similar data processing device and the instructions viewed on a monitor or display as needed or desired.

Figure 2:
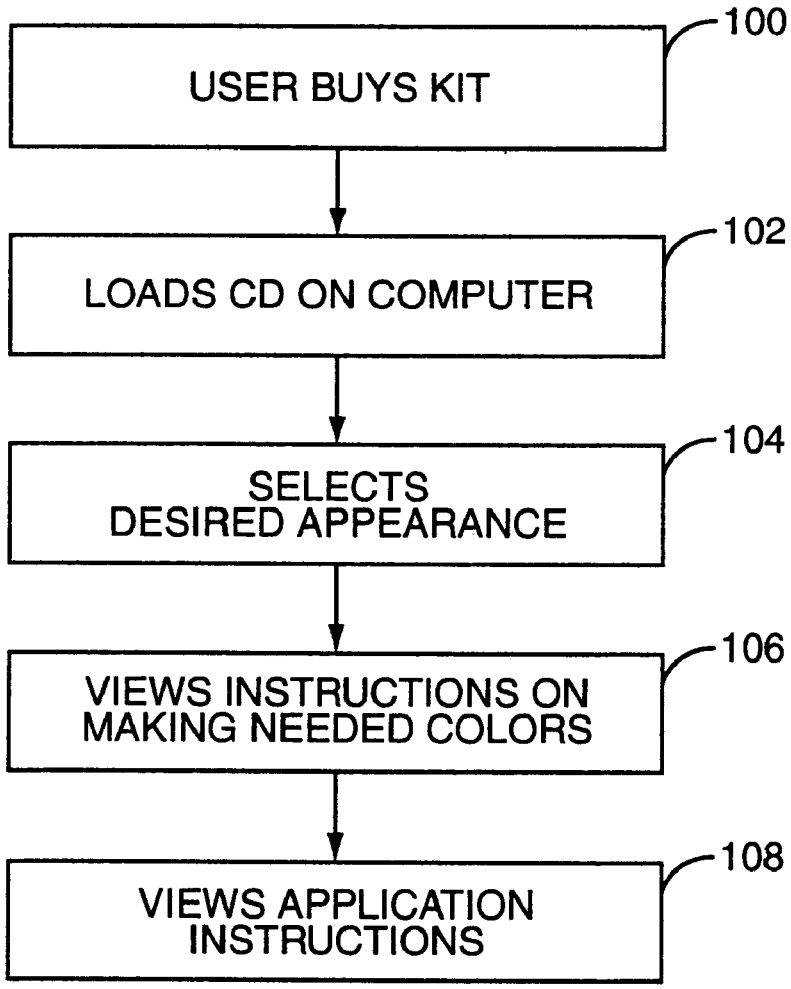
FIG. 2 illustrates a flow chart on how the make up kit of FIG. 1 may be used according to one embodiment of the present invention.

An exemplary flow chart of how a user may use make up application kit 10 is illustrated in FIG. 2. Specifically, a user may purchase the make up application kit 10 from a store or the like (block 100). In the event that instructional guide 30 is a compact disc, the instructional guide 30 is loaded onto a computer (block 102). Suitable software launches the instructional guide 30 and the user may be allowed to select from several predetermined appearances (block 104). For example, a clown, a goblin, a pirate, or the like may all be listed in a menu format and the user may select one. Alternatively, thumbnail sized pictures may be presented and link to the desired instructions. Other software arrangements are possible.

Once a desired appearance is selected, the user may view the instructions on making the needed colors for the desired appearance (block 106). These instructions may include ratios and volumes of base material 22 to colorants 24 as well as mixing instructions. In one embodiment, the mixing instructions may comprise a brief video clip that illustrates how the materials should be mixed. Intermixed with the mixing instructions, or presented after the mixing instructions the application instructions may be provided (block 108). Specifically, the user may be shown how to apply the make up in a manner that is designed to increase the likelihood that a make up job looks like the intended appearance. For example, the user may be shown how to make a happy clown face and where to apply the red make up over the white make up and how to highlight cheek bones or the like. Tricks on how to make realistic looking scars and the like may also be presented for more ghoulish make up jobs. Again, this may be done with video clips, pictures, audio clips, and the like.

When instructional guide 30 is a printed item, the same instructions may be provided, albeit in a static form. The user may turn the page as appropriate to learn the next step in the process and refer to pictures or drawings which illustrate the mixing of the make up and the application thereof to a user.

Figure 3:
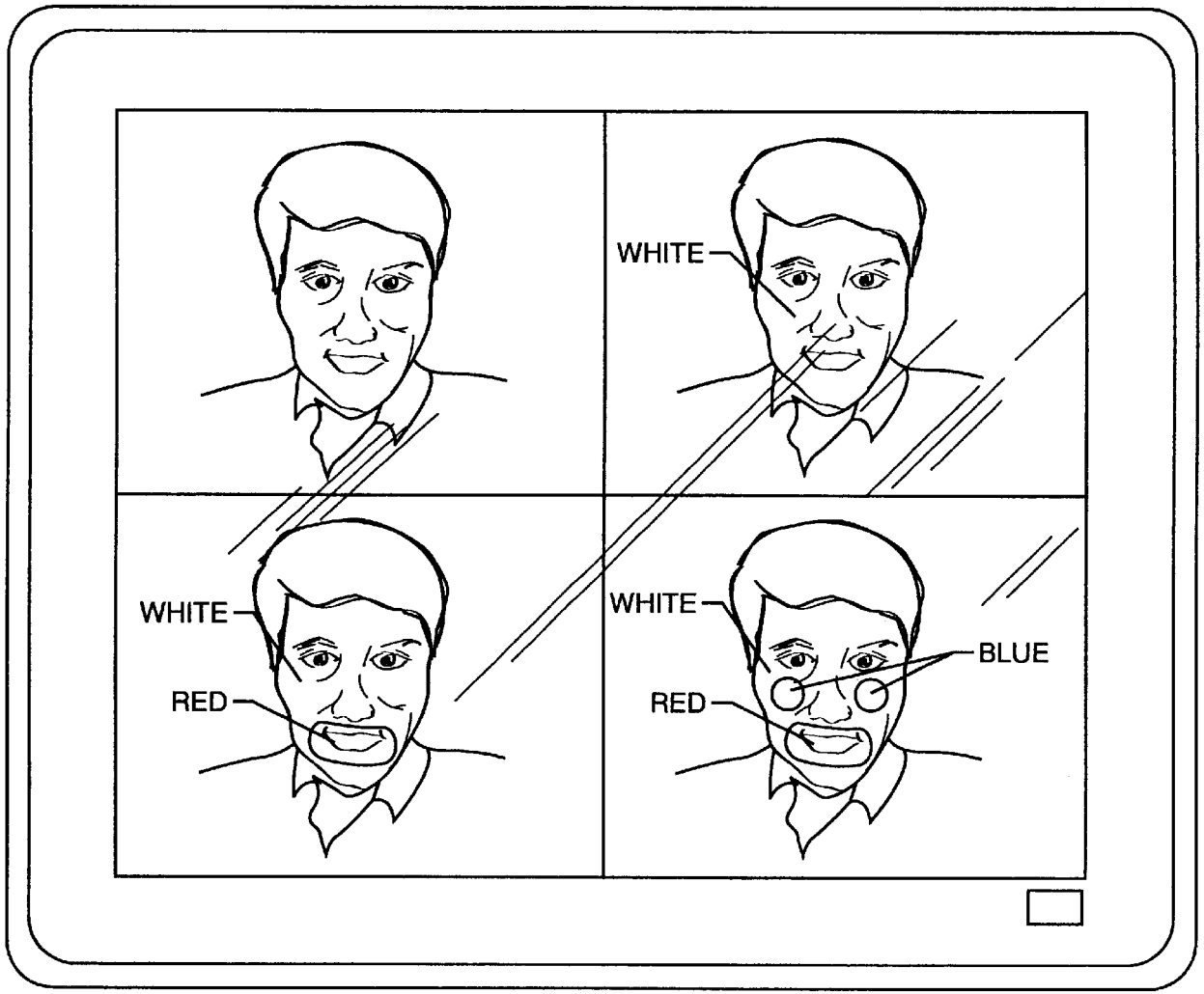
FIG. 3 illustrates an exemplary screen shot from an instructional compact disc.

FIG. 3 illustrates an exemplary screen shot from the compact disc as a user might see it. In the screen shot, a manikin goes through various stages as the make up is applied. Other arrangements are also possible and this illustration is intended to be illustrative and not limiting.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of selling make up comprising:

positioning a base material on a header card;

positioning a plurality of colorants on said header card, each of said plurality of colorants adapted to be mixed with said base material to form make up of differing hues, wherein said plurality of colorants include at least one glitter color;

positioning an instructional guide on said header card;

enclosing said base material, said plurality of colorants and said instructional guide within a transparent blister cover secured to said header card; and selling a resultant make up kit.

2. The method of claim 1 further comprising positioning an applicator on said header card.

3. The method of claim 1 wherein positioning an instructional guide on said header card comprises positioning a compact disc on said header card.

4. The method of claim 1 further comprising positioning a mixing dish on said header card.

5. The method of claim 1 wherein positioning an instructional guide on said header card comprises positioning a pamphlet on said header card.

6. The method of claim 1 further comprising positioning at least one of a mirror and an applicator on said header card.

7. The method of claim 6 wherein positioning said applicator on said header card comprises positioning a brush or a sponge on said header card.

8. The method of claim 1 wherein positioning an instructional guide on said header card comprises positioning an instructional guide on said header card, said instructional guide including instructions on how to mix said base material with one or more of said plurality of colorants to create make up paints of differing hues and instructions on how to apply said make up paints to achieve a desired effect.

9. The method of claim 1 further comprising:

positioning an applicator on said header card;

positioning a mirror on said header card;

positioning a mixing dish on said header card; and wherein positioning an instructional guide on said header card comprises positioning a pamphlet including instructions on how to mix said base material with one or more of said plurality of colorants to create make up paints of differing hues and instructions on how to apply said make up paints to achieve a desired effect.

10. A make up application kit, comprising:

a header card;

a base material contained within a container and secured to said header card;

a plurality of colorants, each contained within a distinct container and secured to said header card, each of said plurality of colorants adapted to be mixed with said base material to create make up paints of differing hues, wherein said plurality of colorants include at least one glitter color;

a mixing dish in which said base material may be mixed with one or more colorants to create make up paints of differing hues; and an instructional guide secured to said header card, said instructional guide comprises instructions on how to mix said base material with differing amounts of said colorants to create make up paints of differing hues and instructions on how to apply said make up paints to achieve a desired effect.

11. The make up kit of claim 10 where in said instructional guide comprises a compact disc.

12. The make up kit of claim 10 wherein said instructional guide comprises a pamphlet.

13. The make up kit of claim 10 further comprising an applicator secured to said header card.

14. The make up kit of claim 13 said applicator comprises a brush or a sponge.

15. The make up kit of claim 10 wherein said base material comprises a cream, a grease, or a powder.

16. The make up kit of claim 10 wherein each of said plurality of colorants comprises a liquid, a paste, a gel, or a powder.

17. The make up kit of claim 10 wherein the instructional guide includes a CD package with the base material, colorant and mixing dish; and wherein the make up application kit is used by inserting the CD in a computer that through a monitor presents a number of appearance options that can be achieved by the make up application kit and wherein each appearance option is provided with directions as to how the base material and colorant can be used to yield a particular appearance option.

18. The make up kit of claim 17 wherein when the CD is loaded in the computer the CD is operative to present through the monitor a sequence of facial designs that illustrate in a step-by-step approach how to apply components of the make up application kit in order to achieve a selected facial appearance.

19. The make up kit of claim 10 further comprising a blister cover to secure at least one of said base material, said plurality of colorants, and said instructional guide to said header card.

20. The make up kit of claim 10 further comprising elastic bands to secure at least one of said base material, said plurality of colorants, and said instructional guide to said header card.

21. The make up kit of claim 10 wherein said plurality of colorants comprise blue, red, yellow, black, white, brown, and purple colorants.

22. The make up kit of claim 10 wherein the make up kit comprises a costume make up kit and wherein the instructional guide comprises instructions on how to apply said make up paints to achieve a desired costume effect.

23. The make up kit of claim 22 wherein the instructions on how to apply said make up paints to achieve the desired costume effect comprise instructions on how to apply said make up paints to achieve at least one of a Frankenstein face, a clown face, and a scar.

24. The make up kit of claim 10 further comprising:

an applicator secured to said header card;

a mirror secured to said header card;

a blister cover to secure at least one of said base material, said plurality of colorants, said instructional guide, said applicator, and said mirror to said header card; and wherein the plurality of colorants comprise blue, red, yellow, black, white, brown, and purple colorants.

* * * * *